US006301331B1

(12) United States Patent
Yokouchi et al.

(10) Patent No.: US 6,301,331 B1
(45) Date of Patent: Oct. 9, 2001

(54) DIGITAL RADIOGRAPHY SYSTEM HAVING AN X-RAY IMAGE INTENSIFIER TUBE

(75) Inventors: Hisatake Yokouchi, Tokyo; Yoichi Onodera, Hachioji; Fumitaka Takahashi, Nagareyama; Mitsuru Ikeda, Noda; Koichi Koike, Kashiwa, all of (JP)

(73) Assignee: Hitachi Medical Corporation, Tokyo (JP)

( * ) Notice: Subject to any disclaimer, the term of this patent is extended or adjusted under 35 U.S.C. 154(b) by 0 days.

(21) Appl. No.: 08/400,287

(22) Filed: Mar. 3, 1995

Related U.S. Application Data

(63) Continuation of application No. 08/141,722, filed on Oct. 25, 1993, and a continuation of application No. 07/791,378, filed on Nov. 14, 1991.

(30) Foreign Application Priority Data

Nov. 16, 1990 (JP) ..... 2-308906

(51) Int. Cl.[7] ..... H05G 1/64
(52) U.S. Cl. ..... 378/98.3
(58) Field of Search ..... 378/99, 98.3; 358/111; 250/213 VT

(56) References Cited

U.S. PATENT DOCUMENTS

| | | | | |
|---|---|---|---|---|
| 3,675,027 | * | 7/1972 | Tsuda et al. | 250/213 VT |
| 3,835,314 | * | 9/1974 | Grossel et al. | 250/213 VT |
| 3,839,634 | * | 10/1974 | Buchmann | 250/213 VT |
| 3,896,331 | * | 7/1975 | Enck et al. | 250/213 VT |
| 4,383,327 | | 5/1983 | Kruger . | |
| 4,852,139 | * | 7/1989 | Sandrik et al. | 378/99 |
| 4,881,124 | * | 11/1989 | Yokouchi et al. | 358/111 |
| 5,022,063 | * | 6/1991 | Yokouchi | 378/98.2 |
| 5,119,409 | * | 6/1992 | Nields et al. | 358/111 |

* cited by examiner

*Primary Examiner*—Craig E. Church
(74) *Attorney, Agent, or Firm*—Antonelli, Terry, Stout & Kraus, LLP

(57) ABSTRACT

A digital radiography system obtaining x-ray images of a patient body through an X-ray image intensifier tube and a video camera optically coupled with the X-ray image intensifier tube. The diameter of an input imaged size of the X-ray image intensifier tube is ranged from 254 to 457 mm, the diameter of an output image size of the X-ray image intensifier tube is ranged from 50 to 90 mm, and the ratio of the diameter of the output image size against the diameter of the input image size is ranged from 4 to 8.

15 Claims, 4 Drawing Sheets

DIGITAL RADIOGRAPHY SYSTEM HAVING AN X-RAY IMAGE INTENSIFIER TUBE

This application is a Continuation application of Ser. No. 08/141,722, filed Oct. 25, 1993. This application is a continuation-in-part divisional of application Ser. No. 07/791,378, filed on Nov. 14, 1991.

BACKGROUND OF THE INVENTION

1. Field of the Invention

This invention relates to an X-ray imaging system for diagnostic use, and in particular to an X-ray radiography system including X-ray image intensifier tube and a video camera for pickup of the output image of the image intensifier tube.

2. Description of the Prior Art

The combination of an X-ray image intensifier tube and a video camera is employed in various diagnostic systems such as for example, X-ray television systems and X-ray radiography system. In a digital radiography (DR) system, video signals, obtained by use of an X-ray image intensifier tube and a video camera, are converted into digital data which is provided to an image processor. According to the Digital Fluoroscopic Angiography (DFA) technique disclosed in U.S. Pat. No. 4,204,225, contrast images of vessels are produced by subtracting postinjection image data from pre-injection image data.

Many commercial digital radiography systems employ X-ray image intensifier tubes having an image input diameter varying between 229 to 406 mm. The output image diameter of these tube is from 20 to 35 mm. The ratio of the input image to the output image (inverse number of image reduction ratio) exceeds 9.

X-ray image intensifier, tubes for performing direct fluoroscopic observation are known. The output image diameter of this type of tube is 100 mm and the ratio of the input image diameter to the output image diameter is 5.7. Another tube of this type has an output image diameter of 205 mm with the same input diameter as the 100 mm tube.

SUMMARY OF THE INVENTION

It is clear from investigation that the output image size of the X-ray image intensifier tube of the prior art digital radiography systems determines a limit of the spatial resolution of the systems. However, the prior art direct observation-type X-ray image intensifier tubes cannot be employed in digital radiography systems. The image detection part of a digital radiography system is mounted to a table on which a patient is positioned. The table has tilt and rotation mechanisms for obtaining X-ray images of the patient at various positions. Further, the height of the table when the table is level is limited to enable easy access. Therefore, there are practical limits for the dimensions of the image detection part of a digital radiography system. The prior direct observation-type X-ray image intensifier tubes have in particular large depths. Further, the output image diameter is too large raising the optical lens system for focusing the output image on a video camera to be too large dimensionally. If an X-ray image intensifier tube from a direct observation type X-ray image intensifier is employed in a digital radiography system, the dimensions of the image detecting part, which include an X-ray image intensifier tube, an optical lens system and a video camera, exceed the practical dimensional limits.

Accordingly, an object of this invention is to provide a digital fluoroscopy system having an improved spatial resolution and dimensions of the image detection part within practical limits.

Another object of this invention is to provide a digital radiography system having high sensitivity.

The image detection part of the digital radiography system according to this invention includes an X-ray image intensifier tube having an input image diameter of 254 to 457 mm, an output image diameter of 50 to 90 mm, a ratio of the input image diameter to the output image diameter having a range of 4 to 8, a video camera picking up the output image of the X-ray image intensifier tube, and an optical lens system focusing the output image of the X-ray image intensifier tube on the video camera.

Furthermore in accordance with the invention, a mirror for changing the optical path of the image is inserted between lenses of the optical lens system and the depth of the image detector part is between 700 and 800 mm.

DESCRIPTION OF THE PREFERRED EMBODIMENTS

Figure 1:
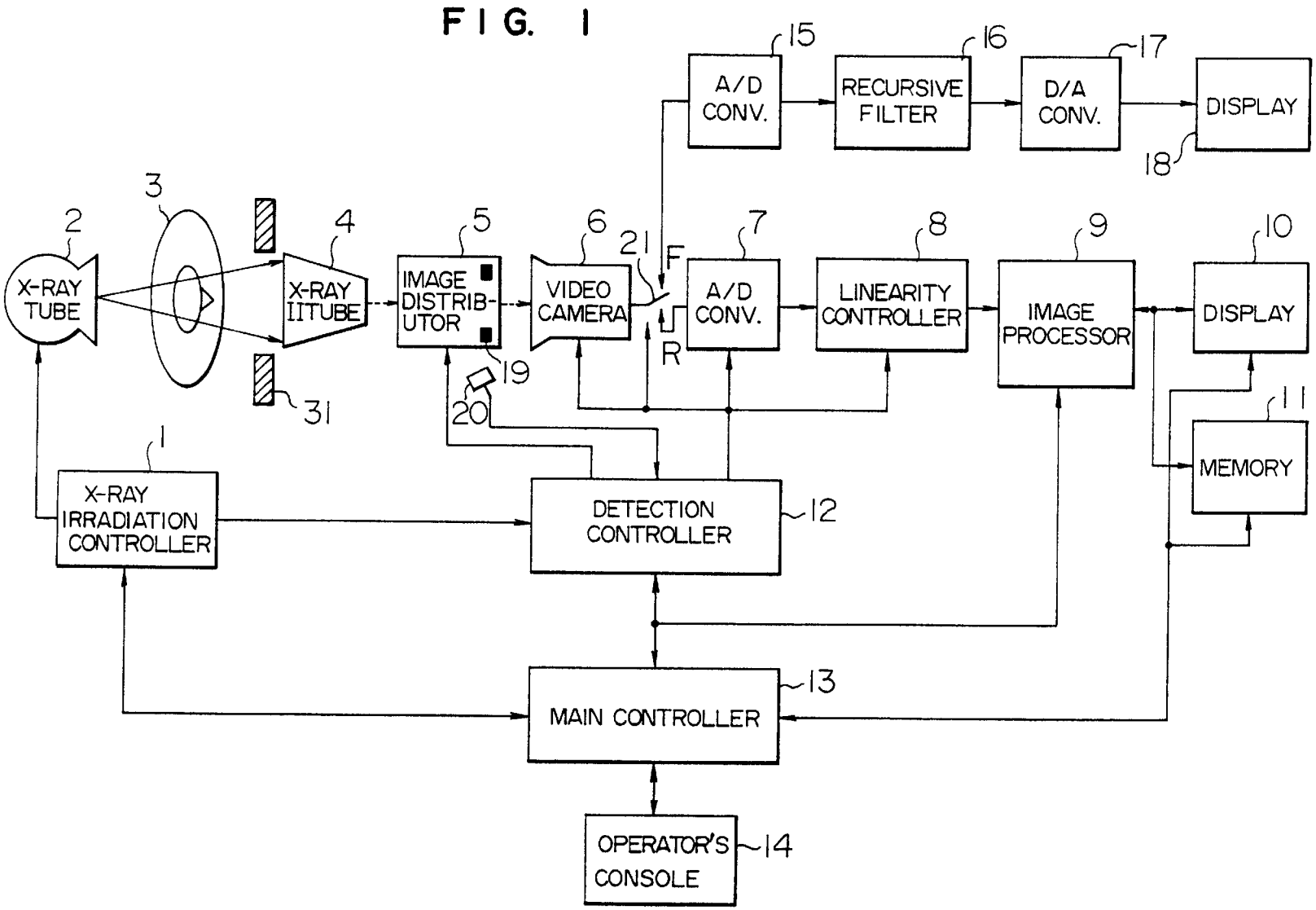
FIG. 1 is a block diagram of an embodiment of the invention.

FIG. 1 is a block diagram of an embodiment of a real-time digital radiography system in accordance with the invention. X-rays generated by an X-ray tube 2 irradiate object 3. X-ray dosage is controlled with an X-ray radiation controller 7. X-ray image intensifier tube 4 converts X-ray images of the object 3 into optical images. An image distributer 5 distributes and optically couples the optical image to a video camera 6. The image distributer 5 includes a tandem lens system, consisting of a primary lens system receiving the output image of the X-ray image intensifier tube 4 and a secondary lens system focusing the optical images on an image receiving surface of the video camera 6. The image distributer 5 is provided with a iris 19 for controlling the quantity of light images onto the image receiving surface and a light detector 20 for detecting the quantity of light imaged onto the image receiving surface.

The X-ray image intensifier tube 4, the image distributer 5 and the video camera 6 form the image detection part of the digital radiography system. The image detection part is mounted to a table 31 on which the object 3 is positioned. The position of the image detection part and the X-ray tube 2 relative to the table 31 can be changed with a shifting mechanism not shown in FIG. 1. Further, the angle of the composite structure comprised of the table 31, the X-ray tube. and the image detection part can be changed with a tilt and a rotation mechanisms not shown in FIG. 1.

The video camera 6 has four different scanning modes. In the first scanning mode, an interlace scanning method having a frame rate of 30 frames per second and 1081 scanning lines is performed. The first scanning mode is employed when the system is in a fluoroscopic monitoring mode, at which continuous X-rays of a low X-ray dose level irradiate the object and a real-time X-ray image of the object is observed. Selection switch 21 is turned to contact F so that the video signal form the video camera 6 is provided to an analog-to-digital converter 15. The digitalized video signal is provided to recursive filter 16 for giving the image a preferred time lag. The filtered signal is provided to display 18 thorough a digital-to-analog converter 17.

Second, third and fourth scanning modes are selected for radiographic imaging in which X-ray images using pulsed X-rays of higher X-ray dose levels are imaged and recorded for diagnosis. In these radiographic imaging modes, the switch 21 turned to a contact R so that the video signal from the video camera 6 is provided to another analog-to-digital converter 7. The digitalized video signal is provided to an image processor 9 through a linearity controller 8. The linearity controller 8 performs gamma control and conversion from liner data to logarithmic data. The image processor 9 performs various image processing operations in accordance with commands transmitted from a main controller 13. The resultant images are stored in memory 11 or displayed with display 10.

Control switches provided on a operator's console 14 perform various functions for example, switches for such a mode selection, setting conditions of the linearity control, setting X-ray dose, and designating operations of storing the data. The main controller 13 generates control signals or commands in accordance with the operation of those control switches.

In each of the second, third and fourth scanning modes, non-interlace scanning is performed by the video camera 6. The number of scanning lines is respectively 525, 1050, and 2100. The frame rates are respectively 60 frames per second, 15 frames per second and 3.75 frames per second. Thus, the fourth scanning modes is a high spacial resolution mode, and the number of pixels in one-frame is 2048×2048. The beam scanning area on an image pickup surface of the video camera 6 is not changed for all four scanning modes. For example, when a ring type 25 mm SATICON (Registered trade mark) is employed, the beam scanning area is 15×15 mm to 16×16 mm. When a pin-lead type 25 mm SATICON is employed, the beam scanning area is 12.5×12.5 mm to 13×13 mm. As a consequence of the X-ray image intensifier tube 4 having a circular output image, the actual image input area on the image receiving surface is a circle on the beam scanning area. If a 50 mm image pickup tube is employed, an image scanning area of 30×30 mm to 32×32 can be achieved. in this case, a beam scanning 4200 scanning lines is effective for improving spatial resolution.

Figure 2:
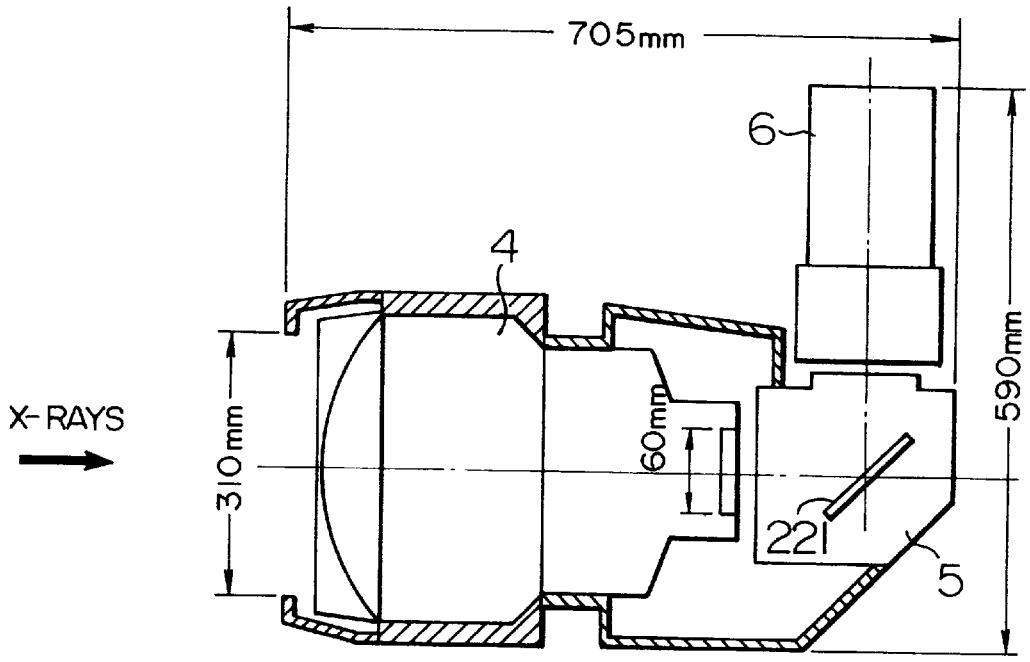
FIG. 2 is a partly sectional view of an image detection part of the embodiment

FIG. 2 shows the image detection part of the embodiments of the invention. The image detection part includes X-ray image intensifier tube 4, image distributer 5 and video camera 6. The image input area of the X-ray image intensifier tube 4 has a diameter of 305 mm. The received X-ray image is converted into an electron distribution at a photo cathode and the electron distribution is converted into an intensified optical image at an output surface. The tube 4 of the embodiment has an effective output image diameter of 60±2 mm. The image distributer 5 includes a primary lens system having focal distance of 200 mm and F number of 1.5, and a secondary lens system having focal distance of 50 mm and F number of 0.65. The light path in the lens system is deflected by 90° with a mirror 221 arranged between lenses in the primary lens system. The output image of the X-ray image intensifier tube 4 is focused by the image distributer on an image receiving surface of the image pickup to be of the video camera 6.

Figure 3A:
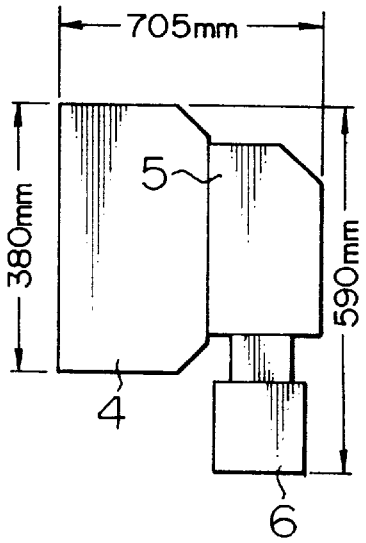
FIGS. 3A and 3B are side views of the image detection part and another image detection part which can be used with the embodiment.
Figure 3B:
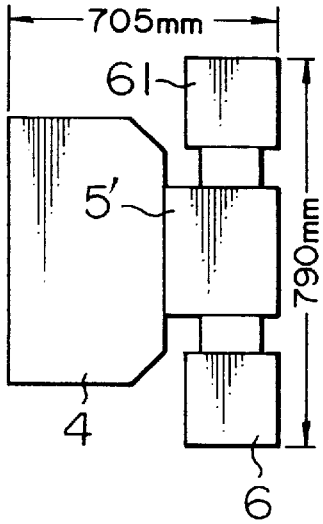

FIG. 3A illustrates dimensions of image detecting part of the embodiment. The depth of the image detection part is 705 mm. When the output image diameter of the X-ray image intensifier tube is around 60 mm, the depth of the image detection part can be reduced to around 700 mm by employing light path deflection. Further, as illustrated in FIG. 3B, an image detection part having both of the video camera 6 and a spot camera 61 can be employed. In the image detection part of FIG. 3B, the angle of the mirror in the image distributer 5 is changed for selecting one of the video camera 6 and the spot camera 61. If the spot camera 61 has an image size of 90 mm in diameter, a secondary lens system for the spot camera is preferable to have focal length of 300 mm and F number of 4.5. Instead of the spot camera 61 or the video camera 6, a cine camera can be used. If a cine camera having an image size of 25.5 mm in diameter is employed, a secondary lens system having focal length of 85 mm and F number of 2 is preferable.

Figure 4:
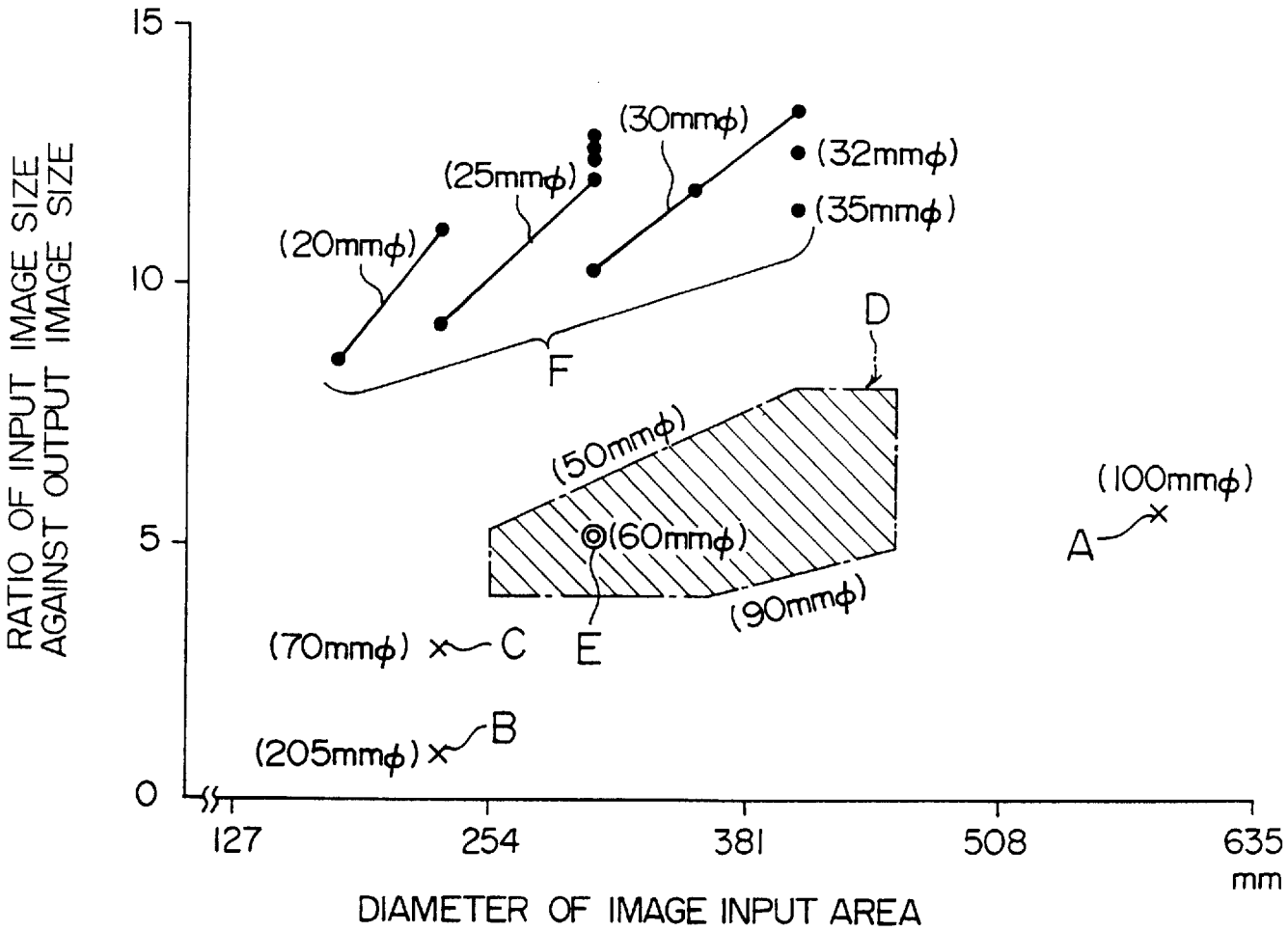
FIG. 4 is a graph of ranges of diameter of an X-ray image intensifier tube according to the invention in comparison with the prior X-ray image intensifier tubes.

FIG. 4 shows a preferable range of dimensions of an X-ray image intensifier tube used in a digital radiography system in comparison with dimensions of prior art X-ray image intensifier tubes. The abscissa is the diameter of the image input area (input image size) of X-ray image intensifier tube which are graduated in a millimeter scale. The ordinate is graduated increments of the ratio of the input image diameter divided by the output image diameter which is an inverse of the image reduction ration of the X-ray image intensifier tubes. The double circled point E denotes the X-ray image intensifier employed in the above mentioned embodiment. The hatched region D denotes the preferable dimension ranges of an X-ray image intensifier for a digital radiography system. The ranges are defined by 254 to 457 mm in the input image diameter, 50 to 90 mm in the output image diameter, and 4 to 8 in the ratio of the input image diameter against the output image diameter. The range of the input image diameter is influenced by the size of human body to be inspected. If an X-ray image intensifier tube having an output image diameter larger than 90 mm is employed, the dimensions of optical system for focusing the output image becomes too large and as a result the depth of the image detecting part exceeds a practical limit around 800 mm. X-ray image intensifier tubes having the output image diameter smaller than 50 mm limit the spatial resolution of resultant image to an unsatisfactory level, particularly in the mode of 2100 scanning lines or 4200 scanning scanning lines. X-ray image intensifier tubes having a ratio of input image diameter to the output image diameter larger than 8 reduce the spatial resolution of resultant images. X-ray image intensifier tubes having the ratio smaller than 4 have a low image intensifying ratio because the electron condensing effect becomes low. Resultantly, the sensitivity of the radiography system becomes low. According to the hatched region E in FIG. 4, the X-ray image intensifier tube allows a high spatial resolution of 2100 or 4200 lines scanning of the video camera. At the same time, a radiography system having a practical size and a sufficient sensitivity can be obtained by employing the X-ray image intensifier tube within the region E.

The area F on FIG. 4 denotes X-ray image intensifiers of prior art radiography systems. According to the dimensions of the prior art system high resolution of 2100 or 4200 lines scanning cannot be obtained. The point C is an X-ray image intensifier tube, proposed in ASTM Special Technical Publication 716, American Society for testing and materials, for use in a radiography system. The ratio of the input image diameter to the output image diameter is 3 which image intensifying effect is not sufficient. The points A and B denote prior art X-ray image intensifier tubes for direct image observation. The tube at point A employs an electron multiplier structure for compensating a low image intensifying effect. The structure causes a low spatial resolution. The tubes A and B are too large for obtaining a practical size image detecting part of a digital radiography system.

Figure 5:
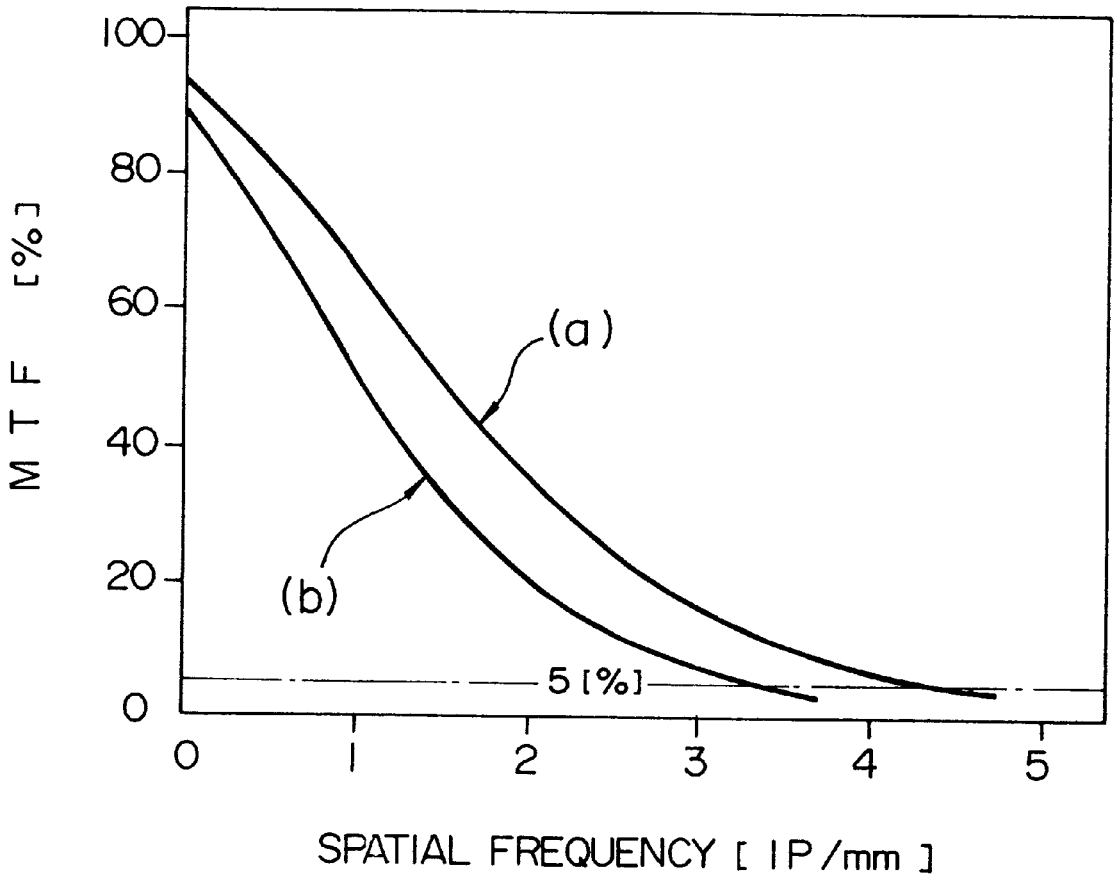
FIG. 5 is a graph of the spatial resolution of the X-ray image intensifier tube employed in the embodiment of the invention in comparison with a prior X-ray image intensifier tube.

FIG. 5 is a graph of the special resolution characteristics of the X-ray image intensifier tube of the above described embodiment. The modulated transfer function (MTF) curve (a) of the embodiment appears at a position higher than the MTF curve (b) of a prior X-ray image intensifier tube having the same input image size and a smaller output image size. The spacial frequency at 5% MTF of the embodiment is 4.5 1p/mm, which is 1.3 times higher than that of the prior X-ray image intensifier tube.

What we claim is:

1. A digital radiography system comprising:

an X-ray source irradiating an object to be inspected with X-rays;

an X-ray image intensifier tube receiving the X-rays which passes through the object and converting the received X-rays into an output optical image, a diameter of an input image of said X-ray image intensifier tube ranging from 305 to 406 mm, a diameter of an output image of said X-ray image intensifier tube ranging from 58 to 62 mm, and a ratio of the diameter of the input image to the diameter of the output image rdnging from 5 to 7;

a video camera picking up the output optical image, said video camera having a plurality of scanning modes including a fluoroscopic mode and a radiographic imaging mode, said fluoroscopic mode monitoring a real-time X-ray image of the object irradiated by the X-rays, and said radiographic imaging mode recording an X-ray image of the object irradiated by X-rays, said video camera having a beam scanning area on an image pickup surface thereof which is the same for both said fluoroscope mode and said radiographic imaging mode;

an optical system including a plurality of lenses, said optical system being disposed between said X-ray image intensifier tube and said video camera so as to output substantially the same size output optical image of the X-ray image intensifier tube on the video camera in both of said fluoroscopic mode and said radiographic imaging mode;

image processing means for converting an output from said video camera into a digital signal to obtain digital image data; and image displaying means for displaying an X-ray image by reading out said digital image data from said image processing means.

2. A digital radiography system according to claim 1, wherein the plurality of scanning modes includes a scanning mode in which a number of scanning lines is one of 525, 1050, 2100 and 4200.

3. A digital radiography system according to claim 1, wherein the plurality of scanning modes includes a scanning mode in which a number of scanning lines is at least more than 1000.

4. A digital radiography system according to claim 1, wherein said optical system includes a combination of a mirror and said plurality of lenses.

5. A digital radiography system according to claim 1, wherein a size of an image detection part constituted of said X-ray image intensifier tube and said video camera ranges from 700 to 800 mm in a direction parallel to a center axis of said X-ray image intensifier tube.

6. A digital radiography system comprising:

an X-ray source irradiating an object to be inspected with X-rays;

an X-ray image intensifier tube receiving the X-rays which passes through the object and converting the received X-rays into an output optical image, a diameter of an input image of said X-ray image intensifier tube ranging from 305 to 406 mm, a diameter of an output image of said X-ray image intensifier tube ranging from 58 to 62 mm, and a ratio of the diameter of the input image to the diameter of the output image ranging from 5 to 7;

a video camera picking up the output optical image, said video camera having a plurality of scanning modes and a beam scanning surface thereof which is the same for all of said plurality of scanning modes;

an optical system being disposed between said X-ray image intensifier tube and said video camera so as to output substantially the same size output optical image of the X-ray image intensifier tube on the video camera in all of said plurality of scanning modes;

image processing means for converting an output from said video camera into a digital signal to obtain digital image data; and image displaying means for displaying an X-ray image by reading out said digital image data from said image processing means.

7. A digital radiography system according to claim 6, wherein said plurality of scanning modes includes a scanning mode in which a number of scanning lines is at least more than 1000.

8. A digital radiography system according to claim 6, wherein a optical system includes a combination of a mirror and said plurality of lenses.

9. A digital radiography system according to claim 6, wherein a size of an image detection part constituted of said X-ray image intensifier tube and said video camera ranges from 700 to 800 mm in a direction parallel to a center axis of said X-ray image intensifier tube.

10. A digital radiography system comprising:

an X-ray source irradiating an object to be inspected with X-rays;

an X-ray image intensifier tube receiving the X-rays which passes through the object and converting the received X-rays into an output optical image, a diameter of an input image of said X-ray image intensifier tube ranging from 254 to 457 mm, a diameter of an output image of said X-ray image intensifier tube ranging from 50 to 90 mm, and a ratio of the diameter of the input image to the diameter of the output image ranging from 4 to 8;

a video camera picking up the output optical image, said video camera having a plurality of scanning modes including a fluoroscopic mode and a radiographic imaging mode, said fluoroscopic mode monitoring a real-time X-ray image of the object irradiated by the X-rays, and said radiographic imaging mode recording an X-ray image of the object irradiated by X-rays, said video camera having a beam scanning area on an image pickup surface thereof which is the same for both said fluoroscope mode and said radiographic imaging mode;

an optical system including a plurality of lenses, said optical system being disposed between said X-ray image intensifier tube and said video camera so as to output substantially the same size output optical image of the X-ray image intensifier tube on the video camera in both of said fluoroscopic mode and said radiographic imaging mode;

image processing means for converting an output from said video camera into a digital signal to obtain digital image data; and image displaying means for displaying an X-ray image by reading out said digital image data from said image processing means.

11. A digital radiography system according to claim 10, wherein the plurality of scanning modes includes a scanning mode in which a number of scanning lines is at least more than 1000.

12. A digital radiography system according to claim 10, wherein said optical system includes a combination of a mirror and said plurality of lenses.

13. A digital radiography system according to claim 10, wherein a size of an image detection part constituted of said X-ray image intensifier tube and said video camera ranges from 700 to 800 mm in a direction parallel to a center axis of said X-ray image intensifier tube.

14. A digital radiography system comprising:

an X-ray source irradiating an object to be inspected with X-rays;

an X-ray image intensifier tube receiving the X-rays which passes through the object and converting the received X-rays into an output optical image, a diameter of an image input area of said X-ray image intensifier tube ranging from 305 to 406 mm, a diameter of an image output area of said X-ray image intensifier tube ranging from 58 to 62 mm, and a ratio of the diameter of the image input area to the diameter of the image output area ranging from 5 to 7;

a video camera picking up the output optical image formed in the image output area of the X-ray image intensifier tube, said video camera having a plurality of scanning modes including a fluoroscopic mode and a radiographic imaging mode, said fluoroscopic mode monitoring a real-time X-ray image of the object irradiated by the X-rays, and said radiographic imaging mode recording an X-ray image of the object irradiated by the X-rays, said video camera having a beam scanning area on an image pickup surface thereof which is the same for both said fluoroscope mode and said radiographic imaging mode;

an optical system including a plurality of lenses, said optical system being disposed between said X-ray image intensifier tube and said video camera so as to output substantially the same size output optical image formed in the image output area of the X-ray image intensifier tube on the video camera in both of said fluoroscopic moae and said radiographic imaging mode;

image processing means for converting an output from sid video camera into a digital signal to obtain digital image data; and image displaying means for displaying an X-ray image by reading out said digital data from image processing means.

15. A digital radiography system comprising:

an X-ray source irradiating an object to be inspected with X-rays;

an X-ray image intensifier tube receiving the X-rays which passes through the object and converting the received X-rays into an output optical image, a diameter of an image input area of said X-ray image intensifier tube ranging from 254 to 457 mm, a diameter of an image output area of said X-ray image intensifier tube ranging from 50 to 90 mm, and a ratio of the diameter of the image input area to the diameter of the image output area ranging from 4 to 8;

a video camera picking up the output optical image formed in the image output area of the X-ray image intensifier tube, said video camera having a plurality of scanning modes including a fluoroscopic mode and a radiographic imaging mode, said fluoroscopic mode monitoring a real-time X-ray image of the object irradiated by the X-rays, and said radiographic imaging mode recording an X-ray image of the object irradiated by the X-rays, said video camera having a beam scanning area on an image pickup surface thereof which is the same for both said fluoroscope mode and said radiographic imaging mode;

an optical system including a plurality of lenses, said optical system being disposed between said X-ray image intensifier tube and said video camera so as to output substantially the same size output optical image formed in the image output area of the X-ray image intensifier tube on the video camera in both said fluoroscopic mode and said radiographic imaging mode;

image processing means for converting an output from said video camera into a digital signal to obtain digital image data; and image displaying means for displaying an X-ray image by reading out said digital image data from said image processing means.

* * * * *